US009669418B2

(12) United States Patent
Kang

(10) Patent No.: US 9,669,418 B2
(45) Date of Patent: Jun. 6, 2017

(54) PUMP FOR DISCHARGING CONTENTS

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 0 days.

(21) Appl. No.: 14/905,278

(22) PCT Filed: Jul. 9, 2014

(86) PCT No.: PCT/KR2014/006151
§ 371 (c)(1),
(2) Date: Jan. 14, 2016

(87) PCT Pub. No.: WO2015/008968
PCT Pub. Date: Jan. 22, 2015

(65) Prior Publication Data

US 2016/0158777 A1 Jun. 9, 2016

(51) Int. Cl.
*B05B 11/00* (2006.01)
*A45D 34/00* (2006.01)
(Continued)

(52) U.S. Cl.
CPC ..... *B05B 11/3025* (2013.01); *A45D 34/00* (2013.01); *B05B 11/3019* (2013.01);
(Continued)

(58) Field of Classification Search
CPC ..... A45D 2200/056; A45D 34/00; B05B 11/3019; B05B 11/3025; B05B 11/3077; F04B 19/22; F04B 23/023; F04B 53/10
See application file for complete search history.

(56) References Cited

U.S. PATENT DOCUMENTS 3,507,586 A * 4/1970 Kutik ..... B05B 11/3032 137/855
4,796,786 A * 1/1989 Czech ..... B05B 11/0032 222/256
(Continued)

FOREIGN PATENT DOCUMENTS

JP 09-225361 A 9/1997
JP 2010-047295 A 3/2010
(Continued)

*Primary Examiner* — Frederick C Nicolas
*Assistant Examiner* — Bob Zadeh
(74) *Attorney, Agent, or Firm* — East West Law Group; Heedong Chae

(57) ABSTRACT

The present invention relates to a pump for discharging contents, which is coupled to a vessel (V) for accommodating the contents and discharges the contents, is configured such that: a suction valve plate (40) closes a content inlet (32) as the volume of the temporary repository (TR) inside the pump main body (10) decreases and pressure is generated in the temporary repository (TR) when the pump upper body (20) is moved downward by pressing the upper surface of the discharge valve (50) or the pump upper body (20); as the valve protruding ring (52), which is in contact with a content outlet (22), is widened due to the pressure, the contents in the temporary repository (TR) pass thorough the widened gap between the content outlet (22) and the valve protruding ring (52) and also pass through a flow path (24), which is the gap between the pump upper body (20) and the discharge valve (50).

14 Claims, 16 Drawing Sheets

(51) Int. Cl.

| | |
|---|---|
| ***F04B 19/22*** | (2006.01) |
| ***F04B 23/02*** | (2006.01) |
| ***F04B 53/10*** | (2006.01) |

(52) U.S. Cl.

CPC ..... *B05B 11/3077* (2013.01); *F04B 19/22* (2013.01); *F04B 23/023* (2013.01); *F04B 53/10* (2013.01); *A45D 2200/056* (2013.01)

(56) References Cited

U.S. PATENT DOCUMENTS

| | | | | | |
|---|---|---|---|---|---|
| 4,946,076 | A * | 8/1990 | Hackmann | B05B 11/0048 | 222/207 |
| 5,193,748 | A * | 3/1993 | Wittersheim | B05B 7/2437 | 222/400.7 |
| 5,197,637 | A * | 3/1993 | Naumann | B05B 11/0051 | 222/207 |
| 7,500,582 | B2 * | 3/2009 | Pritchett | B05B 11/0043 | 222/321.7 |
| 2016/0158777 | A1 * | 6/2016 | Kang | B05B 11/3019 | 222/383.1 |
| 2016/0303601 | A1 * | 10/2016 | Kang | B65D 83/00 | |
| 2016/0303602 | A1 * | 10/2016 | Kang | B05B 11/3001 | |

FOREIGN PATENT DOCUMENTS

| | | | |
|---|---|---|---|
| KR | 20-0405397 | Y1 | 1/2006 |
| KR | 10-2011-0068196 | A1 | 6/2011 |
| KR | 10-2011-0084084 | A | 7/2011 |

* cited by examiner

PUMP FOR DISCHARGING CONTENTS

TECHNICAL FIELD

The present invention relates to a pump for discharging contents, which is used mounted on a container to discharge the contents contained in the container to an outside by a predetermined amount at a time for use. In particular, the present invention relates to a pump for discharging contents, in which a pump upper body is inserted into an upper inside of a pump main body and a valve protruding wheel of a discharge valve is inserted into an extension protrusion wheel of an upper portion of the pump upper body to discharge contents according to the vertical movement of the pump upper body moves up in a pump main body, so that the structure is simple, thereby increasing productivity and reducing the product price. In addition, the pumping is performed by varying the volume of a content temporary repository according to the vertical movement of the pump upper body in the pump main body, so that the pump for discharging contents has a short working stroke distance, thereby allowing the pump to be easily installed in a product having a small pump installing space.

BACKGROUND ART

In general, as one means for discharging a suitable amount of contents, such as cosmetics, shampoo, detergent or medicine, contained in a container, a discharging pump is mounted on a container for use.

The discharging pumps according to the related art, which are mounted on a container and used to dispense a small amount of contents as described above, have been variously proposed. As shown in FIGS. 1 and 2, a general content discharging pump includes a pump body 110 in which an opening and closing ball 122, an operating piston 123 elastically supported by a spring, and a cylinder 120 for allowing the contents in a contents storing chamber 126 to be dispensed through a push button 140 by generating pressure in the contents storing chamber 126 with the operating piston 123 are installed.

An air-tight piston 124 is further installed to the operating piston 123 and the push button 140 is installed in an operating tube 130 coupled to the operating piston 123 of the cylinder 120.

According to the above-described content discharging pump of the related art, when the push button 140 is pushed, an air gap is generated between the air-tight piston 124 and the operating piston 123. In this case, a pressure is generated in the contents storing chamber 126 while the air-tight piston 124 and the operating piston 123 together move down, so that the contents are dispensed through a contents transferring passage 123*a* of the operating piston 123 due to the pressure.

In this case, the opening and closing ball 122 is tightly closed to a contents introducing passage 125 by the compressed spring 121 so that the contents introducing passage 125 is closed.

After the push button 140 is pushed to dispense contents as described above, when the pushed button 140 is released from the external force applied thereto, as shown in FIG. 2, the operating piston 123 and the air-tight piston 124 move up together due to the repulsive elastic force accumulated in the spring 121.

At the initial lifting stage of the operating piston 123 and the air-tight piston 124 ascending as described above, while the air-tight piston 124 is stooped ascending due to the friction with an inside of the cylinder 120, the operating piston 123 first moves up to close the air gap between the operating piston 123 and the air-tight piston 124, so that the contents transferring passage 123*a* is closed and the elastic force accumulated in the spring 121 is weakened.

In the state that the contents transferring passage 123*a* is shut off, when the operating piston 123 and the air-tight piston 124 are continuously lifted up, a vacuum pressure is generated in the contents storing chamber 125 and the opening and closing ball 122 is spaced apart from the contents introducing hole 125 due to the vacuum pressure generated in the contents storing chamber 126, so that the contents in the container are introduced into the contents storing chamber 126.

The content discharging pump according to the related art dispenses the contents while repeatedly performing the above-described operation.

However, the content discharging pump has a major drawback that, since a metallic ball and metallic spring are used as the opening and closing means for discharging contents, the metallic ball and metallic spring are corroded due to chemical reaction with the contents so that the contents are polluted. In addition, since synthetic resin and metal are used as materials of the content discharging pump, when the used content discharging pump is discarded, it is difficult to separate the synthetic resin and metallic materials from each other, so that it is difficult to perform resource recycling.

Specifically, the structure of the content discharging pump according to the related art is complex, so that the productivity is deteriorated and the product price is increased. In addition, since the discharging pump structurally has a long working stroke distance, when the discharging pump is applied to a product such as a compact having a height less than a width thereof, it is difficult to mounting the discharging pump on the product due to a small installing space.

To solve the problems described above, as shown in FIGS. 3 to 5, there has been proposed a content discharging pump having a simple structure in Korean Parent Application No. 10-2013-69816. The content discharging pump includes a deformable pressure member 260 serving as a cylinder and an opening/closing valve to have a simple structure, so that the productivity is increased and the product price is reduced. In addition, the deferrable pressure member 260 is deformed to vary the volume of a content temporary repository TR for pumping, so that the content discharging pump has a short working stroke distance, thereby allowing the pump to be easily installed in a product having a small pump installing space.

According to the content discharging pump which is coupled to a container 210 for containing contents to discharge the contents, when a push button 250 moves down, a deformable pressure member 260 is pressed, deformed, and moves downward, so that the volume of the temporary repository TR in the pump main body 220 constituting a pump upper body 222 and a pump lower body 224 is reduced to generate pressure in the temporary repository TR. Thus, a valve plate 240 closes a content outlet 226, and a valve protrusion wheel 262, which is in tight contact with a content opening/closing piece 252, is widened due to pressure, causing the contents in the temporary repository (TR) to pass through a space between the content opening/closing piece 252 and the valve protrusion wheel 262 and be discharged through an outlet 254. Thereafter, when the pressure on the push button 250 is removed, the push button 250 moves up by the restoring force of an elastic member 270 and the deferrable pressure member 260 pressed by the push button 250 is restored to the original state thereof. Thus, the pressure generated in the temporary repository TR disappears, and vacuum pressure is generated, causing the closure of the space between the valve protrusion wheel 252 of the deferrable pressure member 260 and the content opening/closing piece 252. As the central part of the valve plate 240 is raised upward due to the vacuum pressure, the boundaries of opening/closing lines 241 are widened. Accordingly, the contents inside the container 210 are transferred to the temporary repository TR through a space between the valve plate 240 and the content outlet 226, and at this moment, the contents, which have passed through the content outlet 226, are transferred into the temporary repository TR through the gaps in the widened opening/closing lines 241 of the valve plate 240. When the vacuum pressure in the temporary repository TR disappears following the transfer of the contents, the widened opening/closing lines 241 are restored to the original state thereof and closed due to the elastic force of the valve plate 240, causing the valve plate 240 to close the content outlet 226.

However, although the volume of the temporary repository TR is varied by the deformation of the deformable pressure member 260 to discharge the contents according to the pressure of the temporary repository TR and, when the pressure of the temporary repository TR is increased, the contents are discharged from the temporary repository TR while the valve protrusion wheel 262 of the deformable pressure member 260 is widened, since the entire deformable pressure member 260 is formed of soft rubber having excellent elasticity, a remaining part of the deformable pressure member 260 may be inflated before the valve protrusion wheel 262 is widened, so that it is difficult to discharge a predetermined amount of contents all the time.

DISCLOSURE

Technical Problem

To solve the problems described above, an object of the present invention is to provide a pump for discharging contents, in which opening/closing means for discharging contents is formed of an elastic material such as rubber or synthetic resin durable to a chemical material so that the opening and closing means can be prevented from being corroded due to the contents, and a metallic material is not used for valve means in the contents dispensing pump so that the used content discharging pump may be recycled.

Another object of the present invention is to provide a pump for discharging contents, which has a simple structure to be easily manufactured so that the productivity is improved and the product price is reduced.

Still another object of the present invention is to provide a pump fox discharging contents, of which a working stroke distance is shortened so that the contents dispensing pump may be easily applied to a product such as a compact having a height less than a width thereof.

Still another object of the present invention is to provide a pump for discharging contents which is divided into a hard pump main body and a pump upper body, where true volume of a content temporary repository in the pump main body is changed according to the vertical movement of the pump upper body in the pump main body so that the contents are discharged according to the pressure of the temporary repository, thereby discharging a constant amount of contents all the time.

Technical Solution

To achieve the objects, according to the present invention, there is provided a pump for discharging contents, which is coupled to a container for containing the contents to discharge the contents. The pump includes:

a suction valve plate (40) which closes a content inlet (32) as a volume of a temporary repository (TR) in a pump main body (10) is reduced and pressure is generated in the temporary repository (TR) when a pump upper body (20) moves down by pressing an upper surface of a pump upper body (20) or a discharge valve (50); and a valve protrusion wheel (52) in tight contact with a content outlet (22) of an extension protrusion wheel (26), wherein the valve protrusion wheel (52) is widened due to the pressure such that the contents in the temporary repository (TR) pass thorough the widened gap between the content outlet (22) and the valve protrusion wheel (52), and then, after passing through a flow path (24) which is a gap between the pump upper body (20) and the discharge valve (50), the contents are discharged through a gap which is created between an upper surface of the pump upper body (20) and an upper peripheral part of the discharge valve (50) as discharge pressure is applied to the upper peripheral part of the discharge valve (50).

wherein, when the pressure on the upper surface of the discharge valve (50) or the pump upper body (20) is removed, the pump upper body (20) moves up by restoring force of an elastic member (60) and a space of the temporary repository (TR) in the pump main body (10) is increased, so that vacuum pressure is generated and the gap between the valve protrusion wheel (52) of the discharge valve (50) and the content outlet (22) is closed, wherein, as boundaries of opening/closing lines (41) are widened while a central part of the suction valve plate (40) is raised upward due to the vacuum pressure, the contents in a container (V) are transferred to the temporary repository (TR) through a space between the suction valve plate (40) and the content inlet (32), wherein the contents, which have passed through the content inlet (32), are transferred into the temporary repository (TR) through the gaps in the widened opening/closing lines (41) of the suction valve plate (40), and wherein, when the contents are transferred so that the vacuum pressure in the temporary repository (TR) disappears, the widened opening/closing lines (41) are restored to an original state thereof and closed due to elastic force of the suction valve plate (40), so that the suction valve place (40) closes the content inlet (32).

According to an embodiment of the present invention, there is provided a pump for discharging contents, which is coupled to a container for containing the consents to discharge the contents.

wherein the pump includes a pump main body (10), a pump upper body (20), a pump lower body (30), a suction valve plate (40), a discharge valve (50) and an elastic member (60), and the pump main body (10) comprises an inner wall (11) formed at a center thereof with a hollow hole perforated in a vertical direction a connecting piece (13) formed at an outside of the inner wall (11); and a bent protrusion wheel (14) integrally formed on an upper inside of the inner wall (11).

The pump upper body (20) includes a vertical wall (21) formed to trove vertically while being inserted into an inner wall (11) of the pump main body (10); an extension protrusion wheel (26) provided at a center of the pump upper body (20) and having a content outlet (22); a lower connecting plate (23) to integrally connect the vertical wall (21) with the extension protrusion wheel (26); and an upper extension piece (28) extending from an upper outside of the vertical wall (21).

The pump lower body (30) is inserted into and coupled to a lower side of the pump main body (10) and includes a flat-shaped blocking plate (31) and a content inlet (32) formed at a center of the flat-shaped blocking place (31).

The suction valve plate (40) has a flat shape and is coupled between the pump main body (10) and the pump lower body (30) to form a plurality of opening/closing lines (41).

The discharge valve (50) is coupled to an upper side of the pump upper body (20) and includes a valve protrusion wheel (52) for opening or closing the content outlet (22) of the pump upper body (20); a coupling protrusion wheel (54) coupled to the pump upper body (20) on an outside of the valve protrusion wheel (52); and a space (53) formed between the valve protrusion wheel (52) and the coupling protruding ring (54).

The elastic member (60) is interposed between the pump main body (10) and the pump upper body (20) to elastically support the pump upper body (20).

Advantageous Effects

According to the present invention, the opening/closing means for discharging contents is formed of an elastic material such as rubber or synthetic resin durable to a chemical material so that the opening and closing means may be prevented from being corroded due to the contents, and a metallic material is not used for valve means in the contents dispensing pump so that the used content discharging pump may be recycled.

Specifically, the contents dispensing pump has a simple structure to be easily manufactured so that the productivity may be improved and the product price may be reduced.

In addition, the contents dispensing pump has a short working stroke distance so that the contents dispensing pump may be easily applied to a product such as a compact having a height less than a width thereof.

In addition, the pump for discharging contents is divided into a hard pump main body and a pump upper body, where the volume of the content temporary repository in the pump main body is changed according to the vertical movement of the pump upper body in the pump main body, so that the contents may be discharged according to the pressure of the temporary repository, thereby discharging a constant amount of contents all the time.

BEST MODEL

Mode for Invention

It should be understood that, the terms used in the specification and the appended claims should not be construed as lighted to general and dictionary meanings, but interpreted based on the meanings and concepts corresponding to technical aspects of the present invention on the basis of the principle that the inventor is allowed to define terms appropriately for the best explanation.

Figure 1:
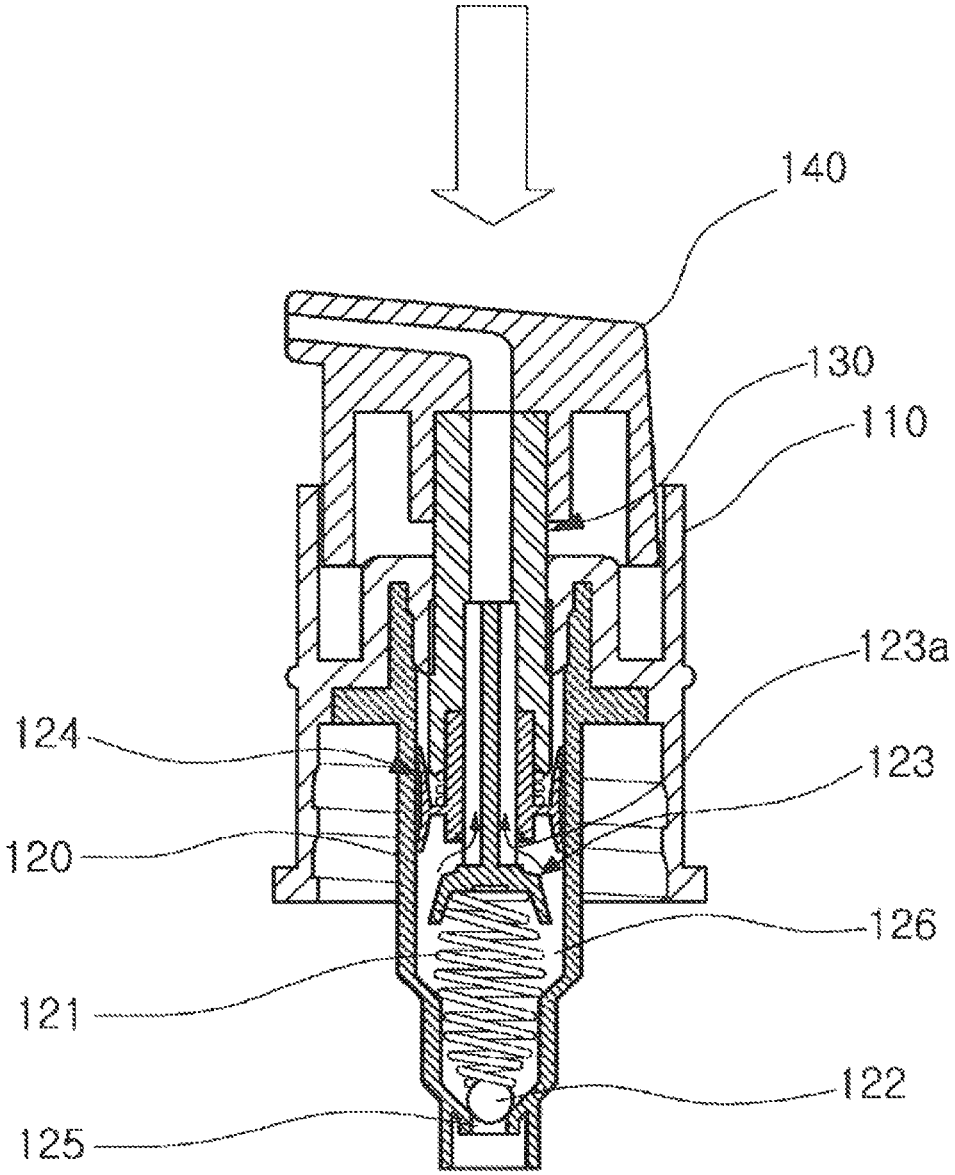
FIG. 1 is a view illustrating an exemplary state that a contents dispensing pump is operated to dispense contents according to the related art.
Figure 2:
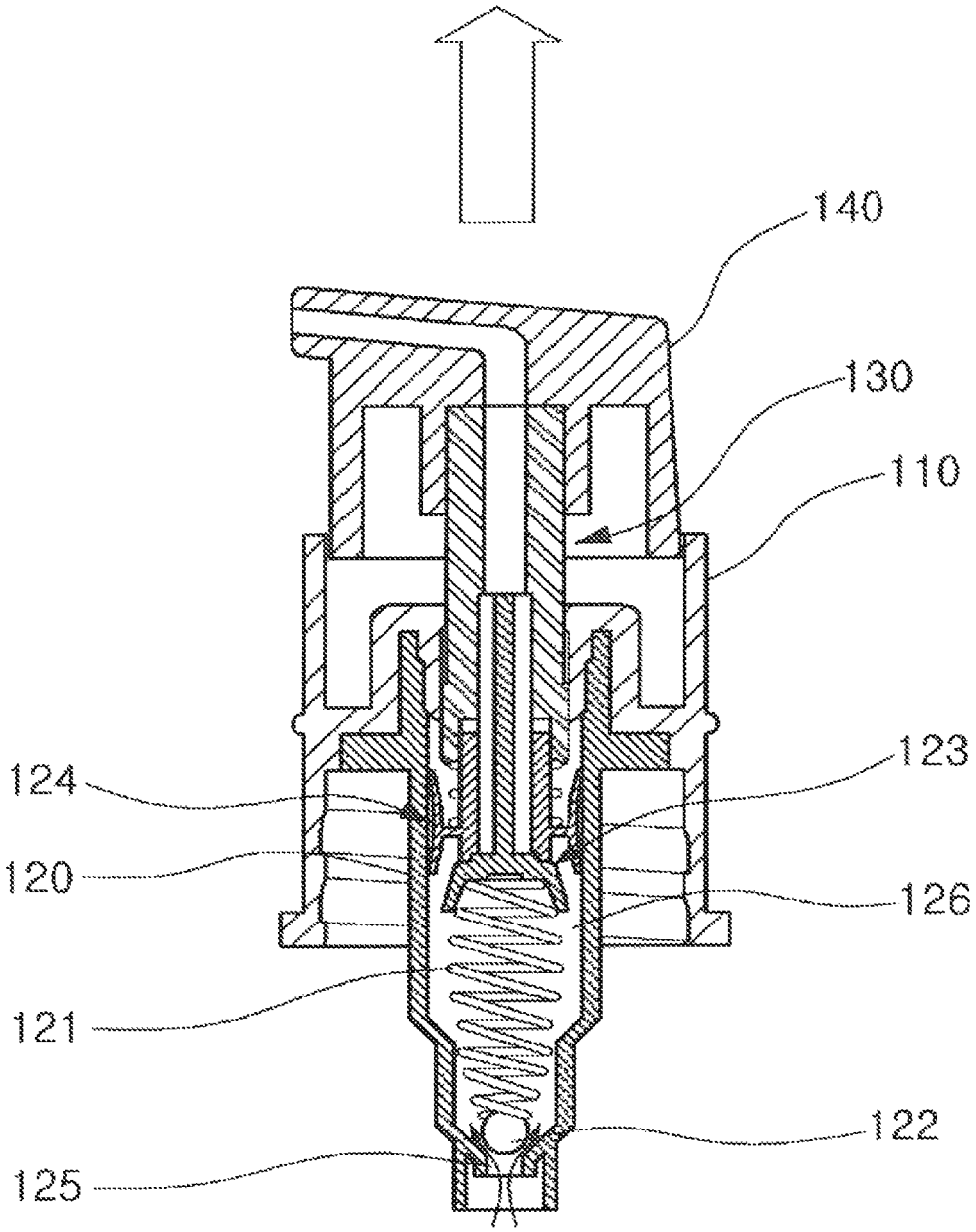
FIG. 2 is a view illustrating an exemplary state that a contents dispensing pump is restored to an original state when force is removed from the contents dispensing pump according to the related art.
Figure 3:
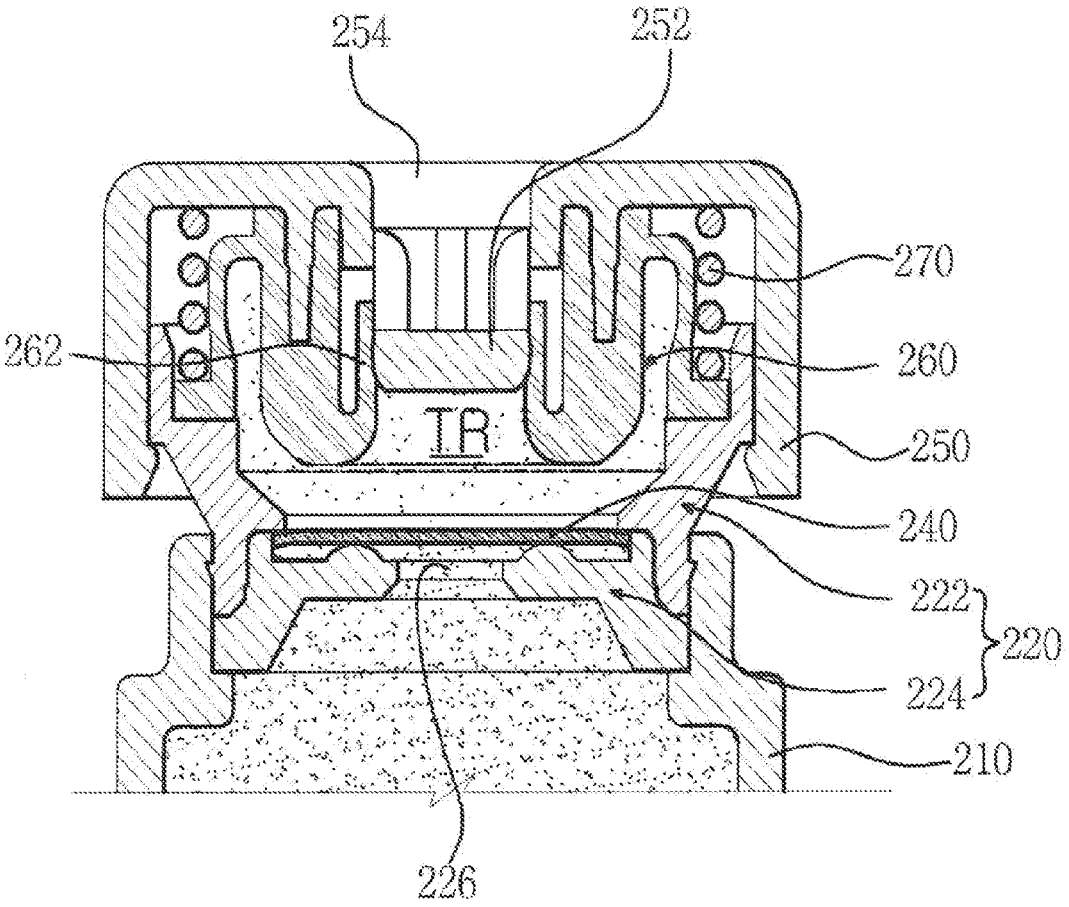
FIG. 3 is a sectional view entirely showing a pump for discharging contents according to another example of the related art.
Figure 4:
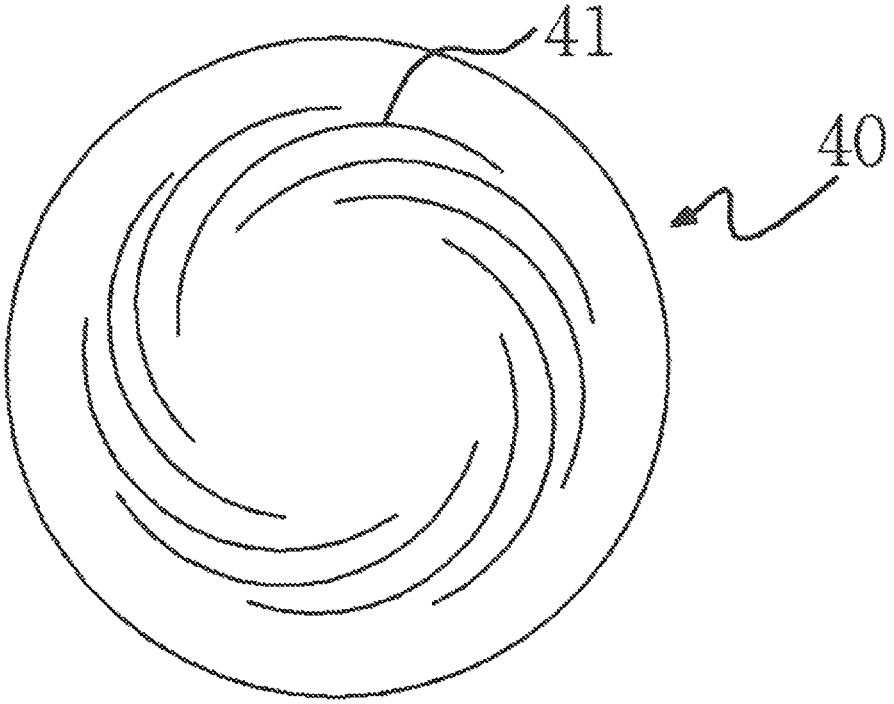
FIG. 4 is a plan view showing a valve plate of a pump for discharging content according to still another example of the related art.
Figure 5:
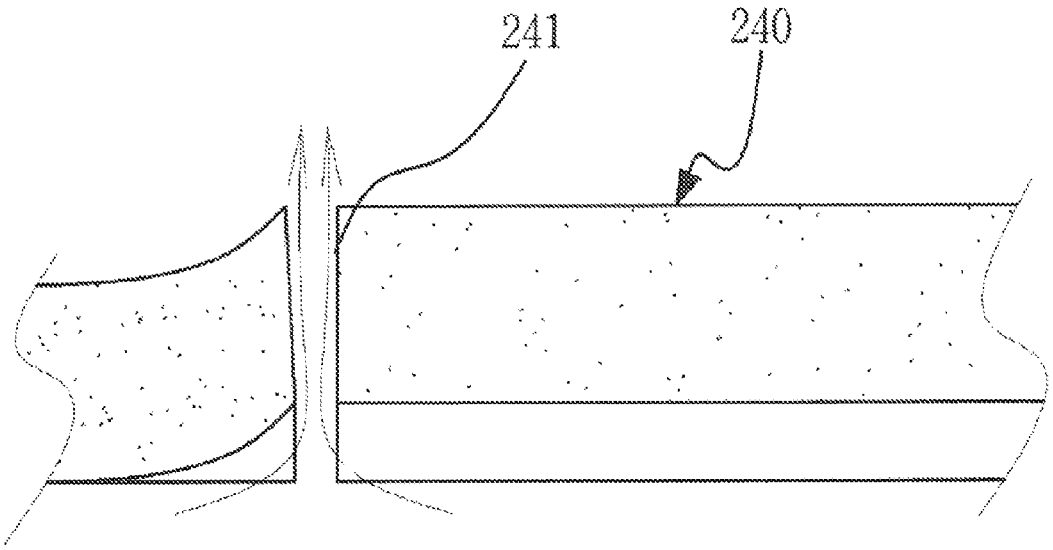
FIG. 5 is a sectional view showing an operating state of opening/closing lines of a valve plate applied to a pump of discharging contents according to still another example of the related art.
Figure 6:
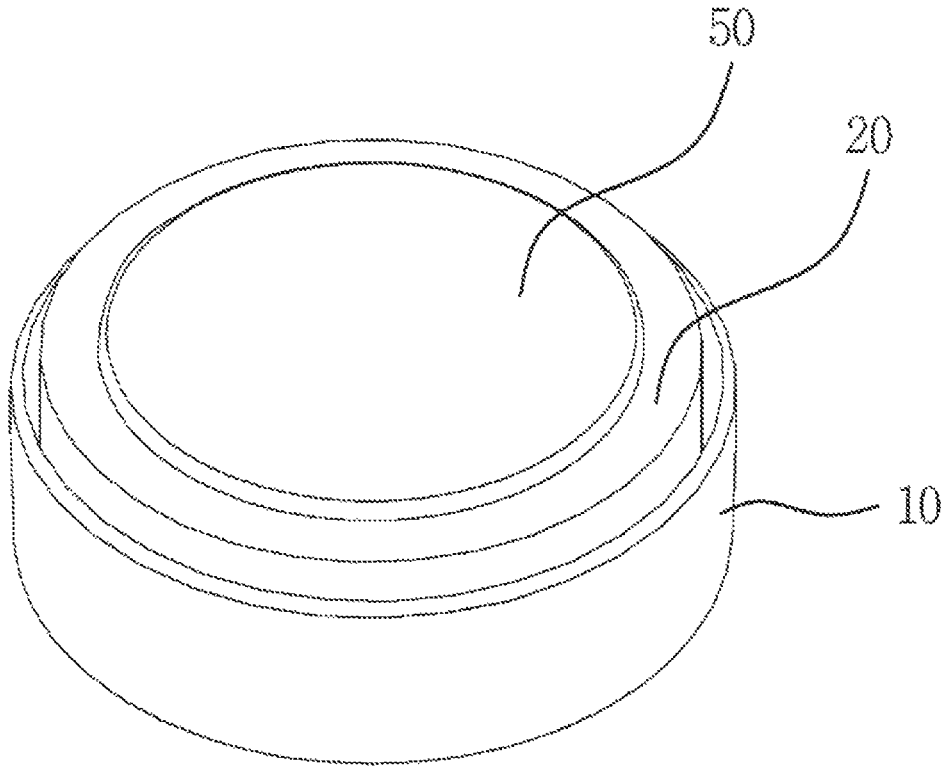
FIG. 6 is an assembled perspective view of a pump for discharging contents according to an embodiment of the present invention.
Figure 7:
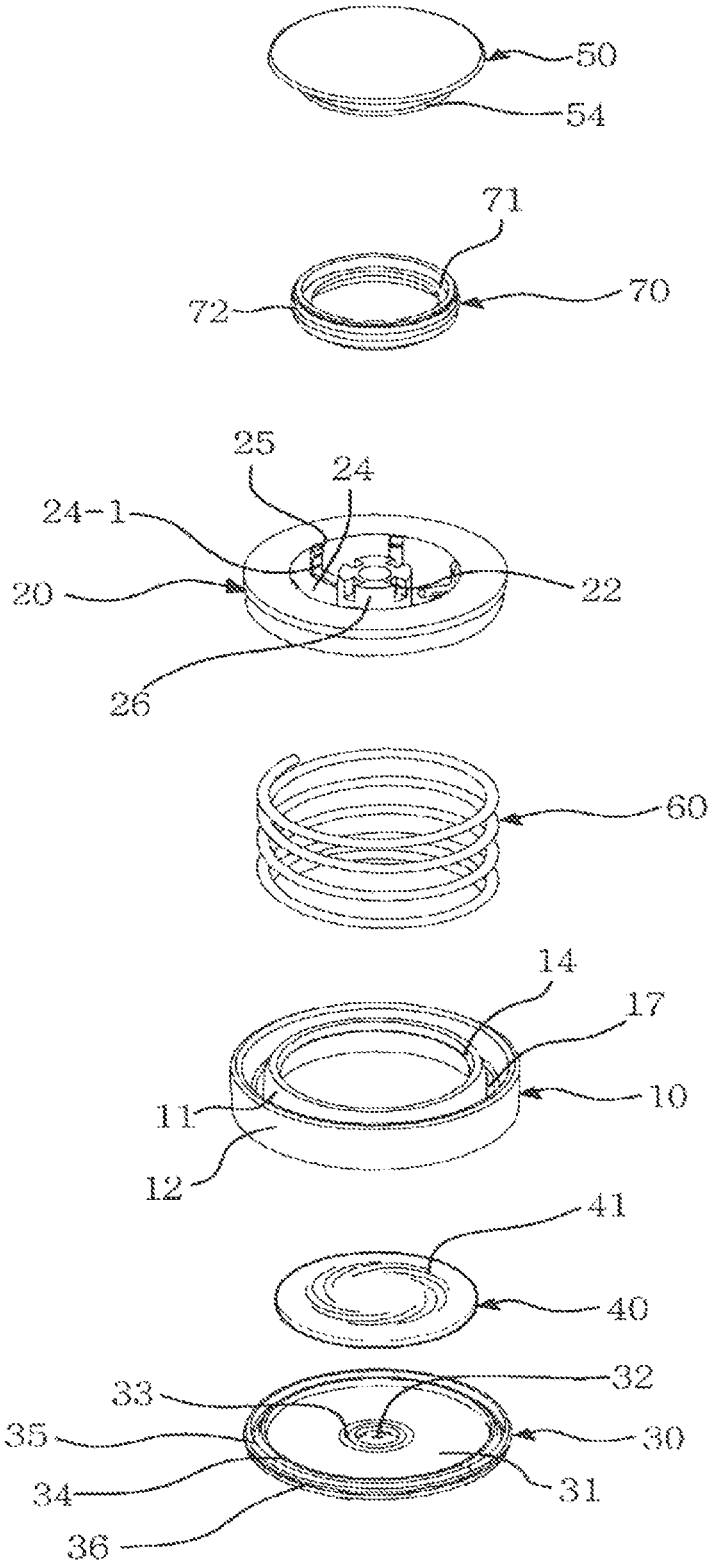
FIG. 7 is an exploded perspective view of a pump for discharging contents according to an embodiment of the present invention.
Figure 8:
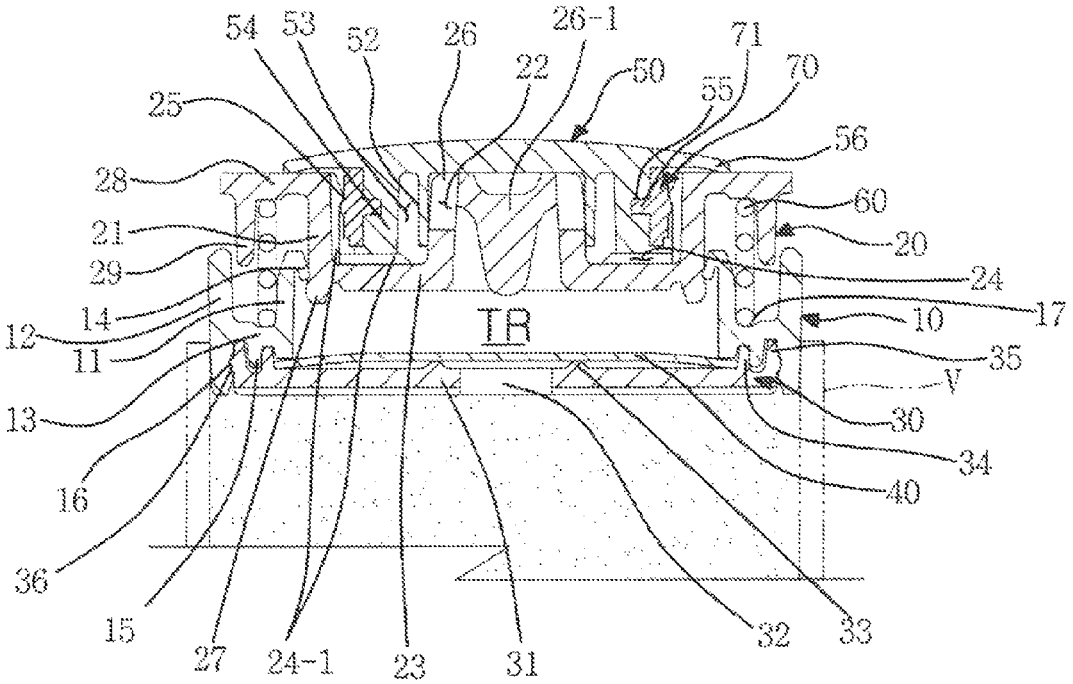
FIG. 8 is an assembled sectional view of a pump for discharging contents according to an embodiment of the present invention.
Figure 9:
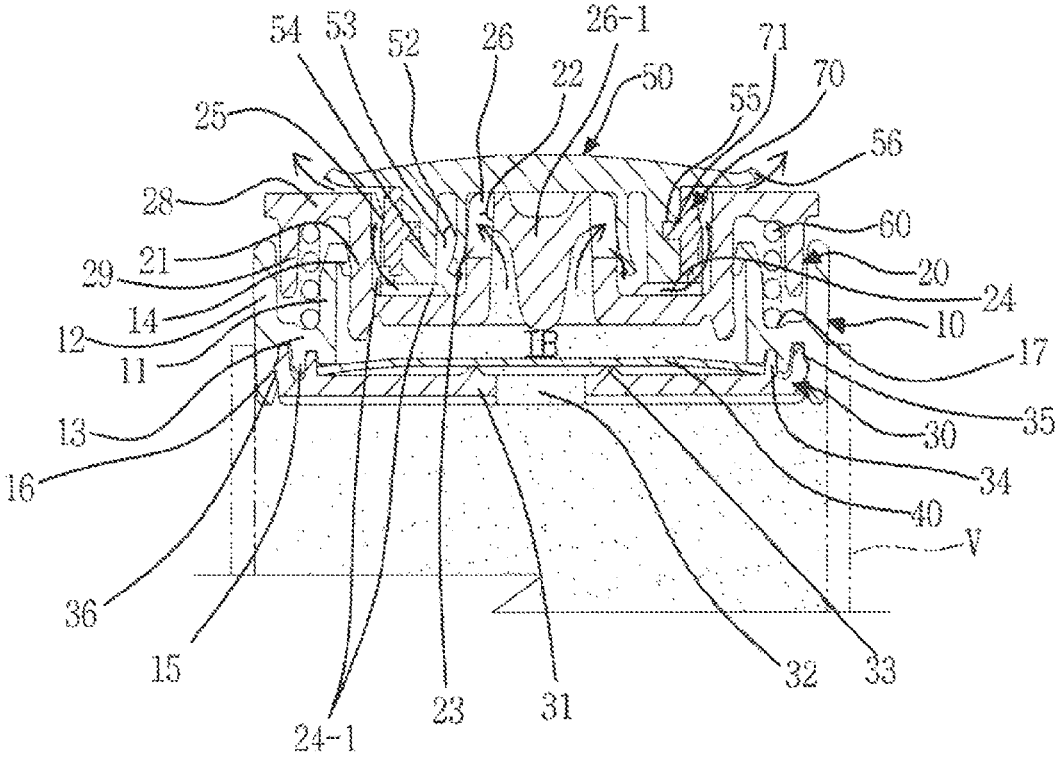
FIG. 9 is a sectional view showing a state that a pump for discharging contents is operated to discharge contents according to an embodiment of the present invention.
Figure 10:
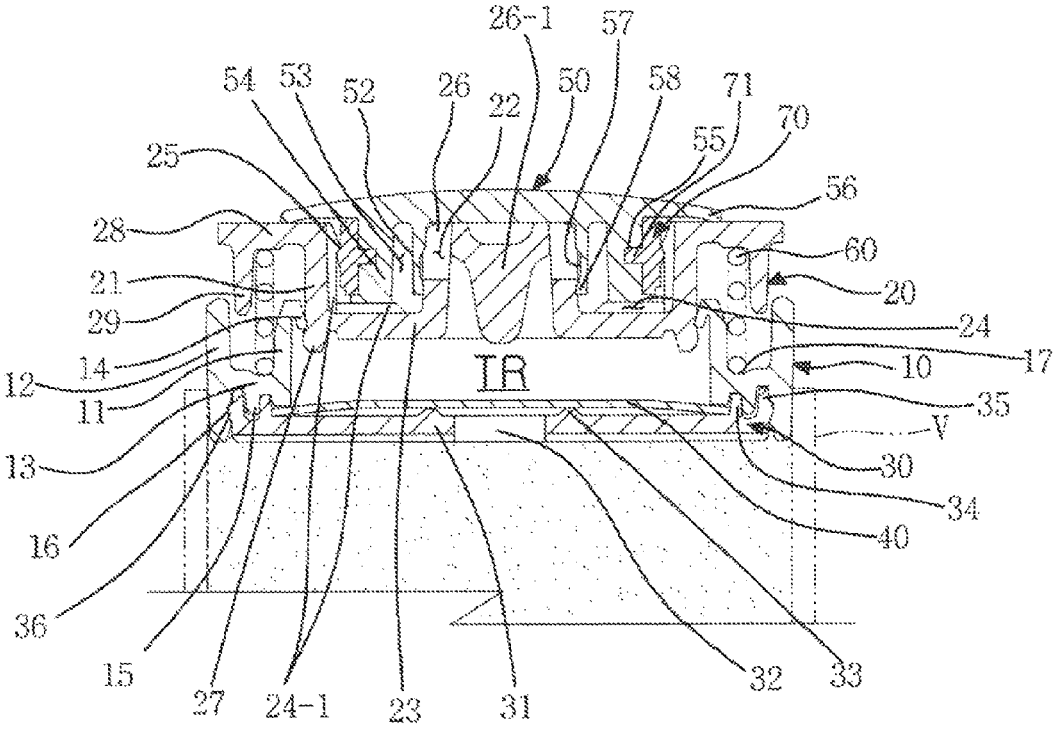
FIG. 10 is an assembled sectional view of a pump for discharging contents according to another embodiment of the present invention.
Figure 11:
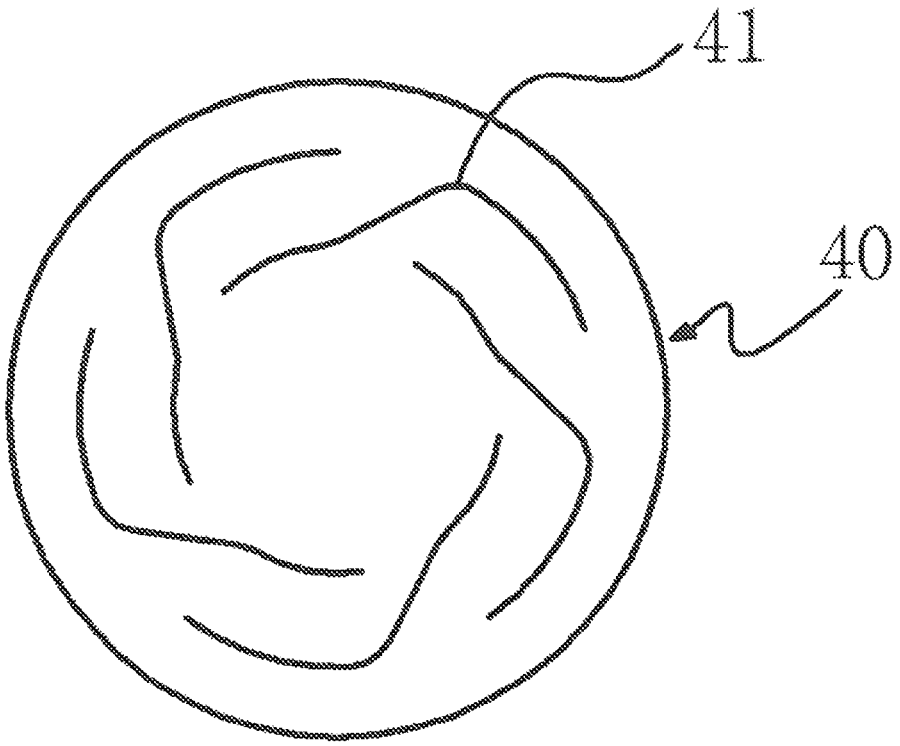
FIG. 11 is a plan view allowing a valve plate applied to the present invention.
Figure 12:
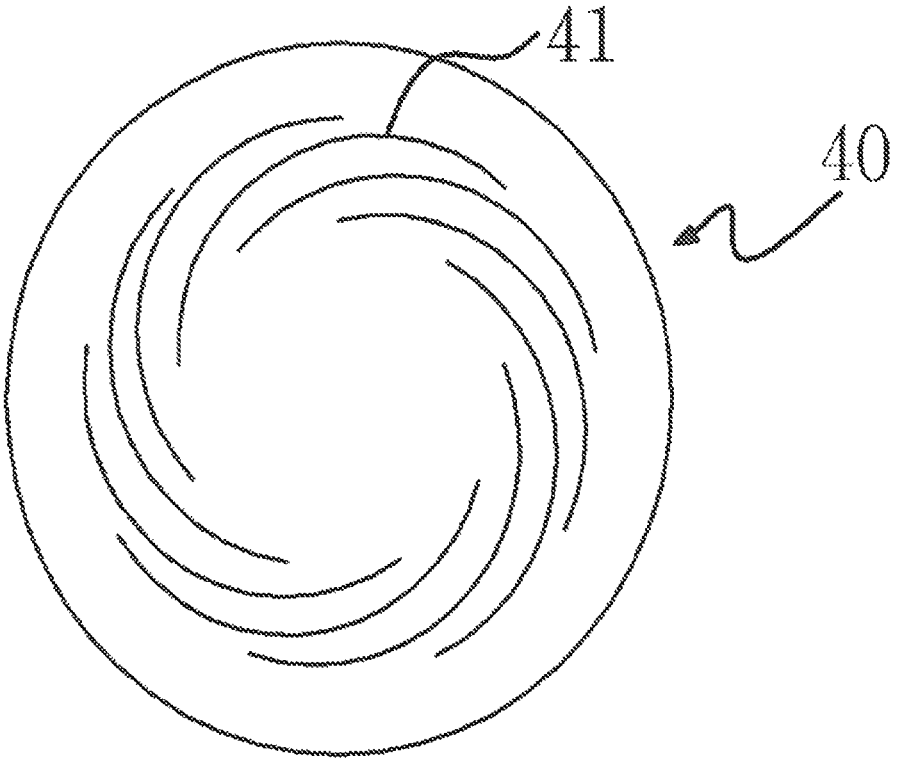
FIGS. 12 to 14 are exemplary views of valve plates applied to the present invention.
Figure 13:
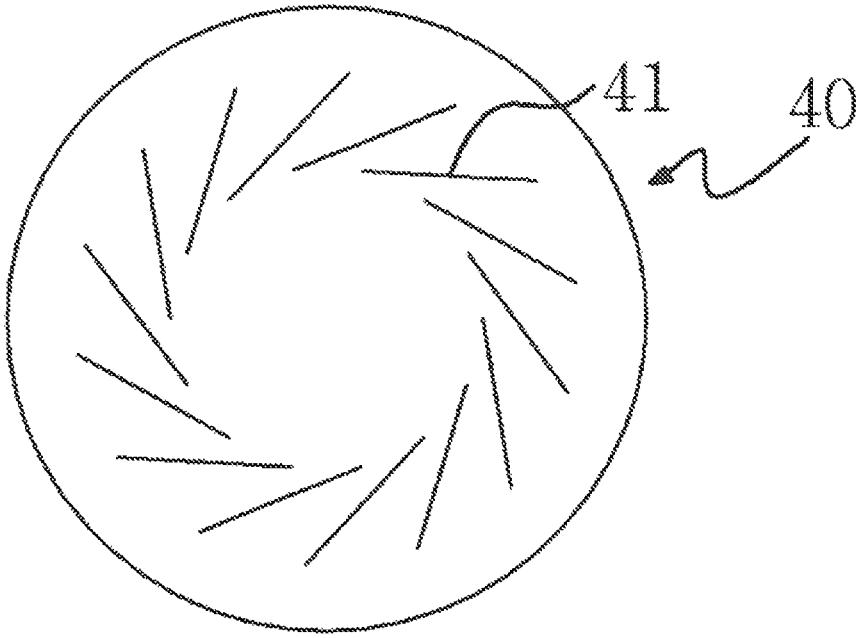
Figure 14:
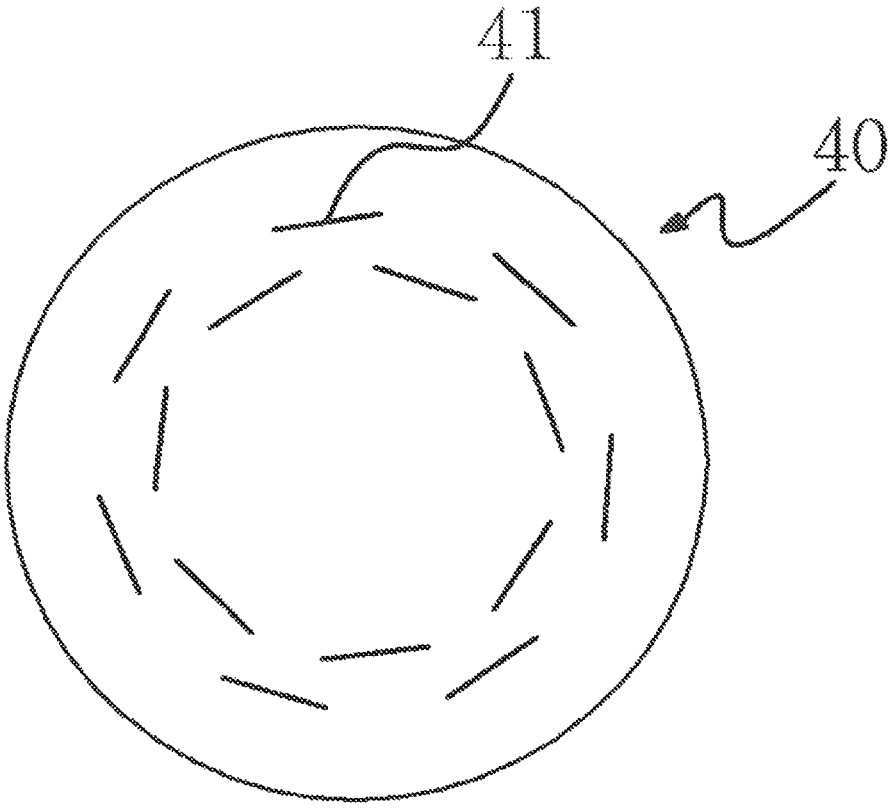
Figure 15:
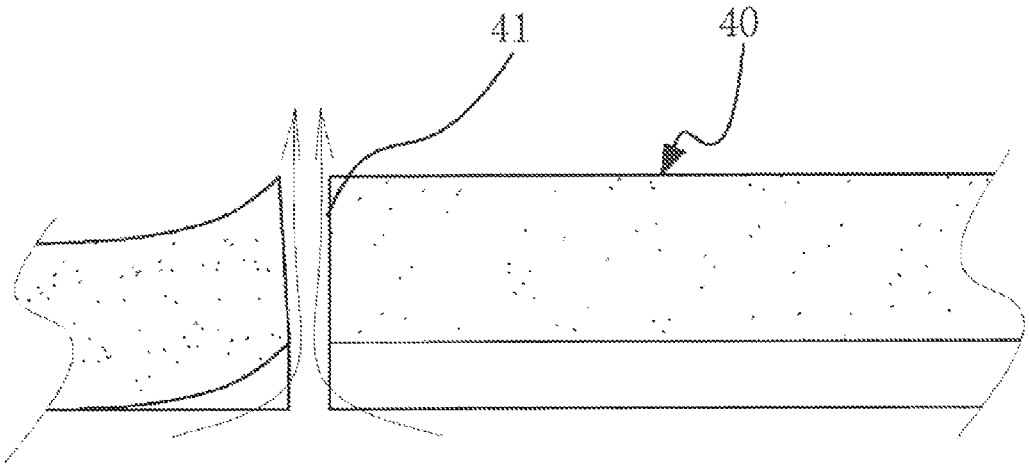
FIG. 15 is a sectional view showing an operating of opening/closing lines of a valve plate applied to the present invention.
Figure 16:
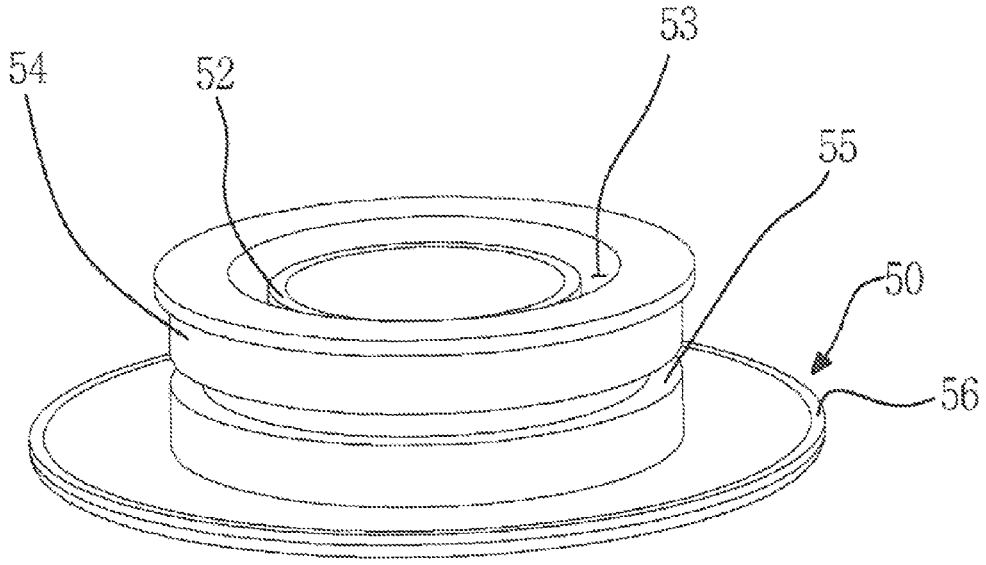
FIG. 16 is a bottom view of a discharging valve applied to the present invention.

FIG. 6 is an assembled perspective view of a pump for discharging contents according to an embodiment of the present invention. FIG. 7 is an exploded perspective view of a pump for discharging contents according to an embodiment of the present invention. FIG. 8 is an assembled sectional view of a pump for discharging contents according to an embodiment of the present invention. FIG. 9 is a sectional view showing a state that a pump for discharging contents is operated to discharge contents according to an embodiment of the present invention. FIG. 10 is an assembled sectional view of a pump for discharging contents according to another embodiment of the present invention. FIG. 11 is a plan view showing a valve plate applied to the present invention. FIGS. 12 to 14 are exemplary views of valve plates applied to the present invention. FIG. 15 is a sectional view showing an operating state of opening/closing lines of a valve plate applied to the present invention. FIG. 16 is a bottom view of a discharging valve applied to the present invention Hereinafter an embodiment of the present invention will be described with reference to accompanying drawings.

As shown in FIGS. 6 to 9, a pump for discharging contents according to an embodiment of the present invention is coupled to a container V for containing the contents and includes a pump main body 10, a pump upper body 20, a pump lower body 30, a suction valve plate 40, a discharge valve 50 and an elastic member 60.

The pump main body 10 includes an inner wall 11 formed at a center thereof with a hollow hole perforated in a vertical direction, a connecting piece 13 integrally formed at the outer center of the inner wall 11 and a bent protrusion wheel 14 formed integrally and inwardly on an upper inside of the inner wall 11.

The inner wall 11 serves as a cylinder of the pump and the hollow hole is a temporary repository TR in which the contents remains until the contents are absorbed and discharged from the container V.

The connecting piece 13 serves as a support on which the elastic member 60 is placed and an outer wall 12 may be further formed at an outside of the connecting piece 13. The outer wall 12 may be utilized as means for coupling the container V thereto and auxiliary means for coupling the pump lower body 30 to a lower part thereof.

The bent protrusion wheel 14 protruding inwardly from an upper part of the inner wall 11 is fitted with a vertical wall 21 the pump upper body 20 so that the air tightness is maintained when the pump upper body 20 moves up or down. Preferably, an inner diameter of the bent protrusion wheel 14 is less than an outer diameter of the vertical wall 21. More preferably, the inner diameter of the bent protrusion wheel 14 is smaller than the outer diameter of the vertical wall 2 by 0.01 mm to 0.5 mm, such that the pump upper body 20 may easily move up or down, in the pump main body 10 while the air tightness is maintained.

Since the bent protrusion wheel 14 protrudes while being bent inwardly, if the vertical wall 21 of the pump upper body 20 having a size greater than the inner diameter of the bent protrusion piece 14, the bent protrusion piece 14 is elastically supported so that the air tightness is maintained between the bent protrusion piece 14 and the vertical wall 21 of the pump upper body 20.

A sealing protrusion wheel 25 may be further formed below the connecting piece 13 to enhance sealing when being coupled to the pump lower body 30. In addition, a coupling groove 16 may be formed inwardly on a lower end of the outer wall 12 and may be coupled to the pump lower body 30. Although the pump main body 10 and the pump lower body 30 which are under-cut coupled to each other are shown in the drawings of the embodiment, the embodiment is not limited thereto.

The connecting piece 13 is provided with an elastic member receiving groove 17 to allow the elastic member 60 to be received thereon.

The pump main body 10 is formed of synthetic resin, preferably, polyethylene (PE).

The pump tapper body 20 includes the vertical wall 21 formed to move vertically while being inserted into an inner wall 11 of the pump main body 10, an extension protrusion wheel 26 provided at the center of the pump upper body 20 and having a content outlet 22, and a lower connecting plate 23 to integrally connect a lower part of the vertical wall 21 to a lower part of the extension protrusion wheel 26.

Since the pump upper body 20 is fitted onto the inner wall 11 of the pump main body 10 and the bent protrusion wheel 14 is formed on an upper end of the inner wall 11 of the pump main body 10, the vertical wall 21 of the pump upper body is inserted into the bent protrusion wheel 14 of the pump main body 10 to vertically move. In this case, since the inner diameter of the bent protrusion wheel 14 is equal to or smaller than the outer diameter of the vertical wall 21, the pump upper body 20 vertically moves in the pump main body 10 while the air tightness is maintained.

A latching protrusion wheel 27 protrudes from an outer peripheral surface of a lower end of the vertical wall 21. Thus, when the pump upper body 20 moves up in the pump main body 10, the bent protrusion wheel 14 of the pump main body 10 is latched to the latching protrusion wheel 27 of the pump upper body 20 such that the pump upper body 20 is prevented from being separated from the pump main body 10.

An upper extension piece 28 extends outward from an upper end of the vertical wall 21 such that the elastic member 60 is elastically supported on a bottom surface of the upper extension piece 28. An outer auxiliary wall 29 is formed integrally and downward on an outer end of the upper extension piece 28. The outer auxiliary wall 29 prevents the elastic member 60 from being separated outward. In addition, when the pump upper body 20 moves down, the outer auxiliary wall 29 controls such that the lower end of the outer auxiliary wall 29 makes contact with the connecting piece 13 of the pump main body 10 to prevent the pump upper body 20 from moving down anymore.

The content outlet 22 is formed on the extension protrusion wheel 26 and a valve protrusion wheel 52 of the discharge valve 50 covers an outside of the extension protrusion wheel 26 while making tight contact with the valve protrusion wheel 52, so that the valve protrusion wheel 52 closes the content outlet 22 usually to prevent the contents from being discharged through the content outlet 22.

A content inducing bar 26-1 having a streamlined surface is formed at an inside of the extension protrusion wheel 26 such that the contents smoothly move to the content outlet 22.

Protrusion pieces 24-1 are formed on an upper surface of a lower connecting plate 23 and an inner surface of the vertical wall 21 of the pump upper body 20, such that a flow path 24, through which the contents are movable, is formed in a space between the protrusion pieces 24-1. A latching sill 25 protrudes from an upper end of the protrusion piece 24-1 and is coupled to the discharge valve 50.

The pump upper body 20 is formed of synthetic resin, preferably, polyethylene (PE).

The pump lower body 30 is inserted into and coupled to a lower side of the pump main body 10 and includes a content inlet 32 formed at the center of a flat-shaped blocking plate 31. A ring-shaped protrusion part 33 protrudes from an upper side of the blocking plate 31 and an outside of the content inlet 32 such that the adhesion of the suction valve plate 40 is enhanced.

A coupling protrusion wall 35 is formed on an outer surrounding surface of the pump lower body 30 and interposed between the outer wall 12 of the pump main body 10 and the sealing protrusion wheel 15. A coupling protrusion wheel 36 is formed on an outer surface of the coupling protrusion wall 35 and inserted into the coupling groove 16 of the pump main body 10.

A sealing protrusion wheel 34 is further formed at an inside of the coupling protrusion wall 35 while being spaced apart from the coupling protrusion wall 35, and is coupled to the sealing protrusion wheel 15 of the pump main body 10, so that the sealing is enhanced.

Although the under-cut coupling of the pump lower body 30 by the coupling groove 16 of the coupling protrusion wheel 36 is described in the embodiment, the embodiment is not limited thereto and the pump lower body 30 may be coupled through a forcibly fitting scheme, a thermal bonding scheme or an adhesive bonding scheme.

The pump lower body 30 is formed of synthetic resin, preferably, polyethylene (PE).

The suction valve plate (40) has a flat shape and is coupled between the pump main body (10) and the pump lower body (30) to form a plurality of opening/closing lines (41).

An inner space surrounded by the pump main body 10, the pump upper body 20 and the suction valve plate 40 is a temporary repository TR in which the contents remain until the contents absorbed from the container V are discharged.

The suction valve plate 40 may be formed of one of general rubber, elastomer, silicon rubber, NBR rubber and synthetic resin. Preferably, the suction valve plate 40 is formed of NBR rubber having excellent functionality and air tightness.

The opening/closing line 41 may be wave-sharped cutting line shown in FIG. 11, an arc-shaped cutting line shown in FIG. 12, a diagonal-sharped cutting line shown in FIG. 13 or a straight cutting line shown in FIG. 14. The shape of the opening/closing line 41 is not limited to the shape of a cutting line and all shapes capable of opening and closing the opening/closing line 41 by the elasticity of the valve plate 40 are usable.

When the pump upper body 20 is pressed to generate pressure in the temporary repository TR, the suction valve plate 40 is tightly closed, to the ring-shaped protrusion part 33 of the valve lower body 30 so that the boundary lines of the opening/closing lines 41 are closed. When the pressure on the pump upper body 20 is removed so that the pump upper body 20 moves up by the elastic member 60 to generate vacuum pressure in the temporary repository TR, as shown in FIG. 15, the central part of the suction valve plate 40 is raised upward to allow the gaps of the opening/closing lines 41 to be widened, so that the contents are transferred from the container V to the temporary repository TR through the gaps of the opening/closing lines 41.

The discharge valve 50 is coupled to an upper side of the pump upper body 20. The discharge valve 50 includes a valve protrusion wheel 52 for opening or closing the content outlet 22 of the pump upper body 20, a coupling protrusion wheel 54 coupled to the pump upper body 20 at an outside of the valve protrusion wheel 52, and a space 53 formed between the valve protrusion wheel 52 and the coupling protruding ring 54 and opened when the contents are discharged by the pressure of the temporary repository TR.

A sealing protrusion wheel 56 further protrudes from an outer periphery of the discharge valve 50 such that the sealing with an upper surface of the upper extension piece 28 of the pump upper body 20 may be enhanced.

The discharge valve 50 may be directly coupled to the pump upper body 20 through the coupling protrusion wheel 54 or a coupling auxiliary member 70.

The coupling auxiliary member 70 is fitted onto an outside of the coupling protrusion wheel 54 of the discharge valve 50 and is coupled to the latching sill 25 of the pump upper body 20.

To this end, the coupling auxiliary member 70 includes a coupling protrusion wheel 71 protruding from an inside thereof in order to couple with the discharge valve 50. A coupling groove 55 is formed on the coupling protrusion wheel 54 of the discharge valve 50. Thus, the coupling protrusion wheel 71 of the coupling auxiliary member 70 is coupled into the coupling groove 55 of the discharge valve 50.

A latching protrusion sill 72 protrudes from an outer surrounding surface of the coupling auxiliary member 70 and is under-cut coupled to the latching sill 25 of the pump upper body 20. Although the coupling auxiliary member 70 which is under-cut coupled to the pump under body 20 has been described in the embodiment of the present invention, the embodiment is not limited thereto and it is possible that the coupling auxiliary member 70 is forcibly fitted with the pump under body 20.

When the discharge valve 50 coupled to the coupling auxiliary member 70 is coupled to the pump upper body 20, the protrusion pieces 24-1 horizontally placed on the pump upper body 20 are in contact with a lower surface of the coupling protrusion wheel 54 of the discharge valve 50 and the protrusion pieces 24-1 vertically placed on the pump upper body 20 are in contact with an outer surface of the coupling auxiliary member 70. In this case, a flow path (24), through which the contents are movable, is formed between the protrusion pieces 24-1.

The discharge valve 50 may be formed of one of general rubber, elastomer, silicon rubber, NBR rubber and synthetic resin. Preferably, the discharge valve 50 is formed of NBR rubber having excellent functionality and air tightness.

As shown in FIG. 10, the discharge valve 50 may include a groove 57 formed on inner surface of the valve protrusion wheel 52 and a sealing protrusion wheel 58 formed on an inner periphery of a lower end of the valve protrusion wheel 52. The sealing protrusion wheel 58 may be tightly closed to the extension protrusion wheel 25 of the pump upper body 20 and may be tightly closed to a lower part of the content outlet 22 of the extension protrusion wheel 26, so that the sealing of the content outlet 26 may be enhanced.

The elastic member 60 is interposed between the pump main body 10 and the pump upper body 20 to elastically support the pump upper body 20.

The elastic member 60 may be formed of one of synthetic resin, elastomer, rubber and metal. When the elastic member 60 may be formed of synthetic resin, elastomer or rubber, the pump for discharging contents according to the present invention may be separated after use for the purpose of waste recycling.

Hereinafter, an assembly method of the present invention described above will be described as follows.

First, the suction valve plate 40 is assembled with the pump lower body 30 below the pump main body (10) and, after an edge of the suction valve plate 40 is tightly closed to a lower end of the inner wall 11 of the pump main body 10, the coupling protrusion wall 35 of the pump lower body 30 is inserted between the outer wall 12 of the pump main body 10 and the sealing protrusion wheel 15. In this case, the pump lower body 30 is assembled to the pump main body 10 by pressing the pump lower body 30, such that the coupling protrusion wheel 36 of the pump lower body 30 is coupled to the coupling groove 16 of the pump main body 10. In this case, the sealing protrusion wheel 34 of the pump lower body 30 is engaged with the sealing protrusion wheel 15 of the pump main body 10 so that a sealing strength is enhanced.

As described above, when the suction valve plate 40 and the pump lower body 30 are assembled with the pump main body 10, an edge of the suction valve plate 40 is pressed between a lower end of the inner wall 11 of the pump main body 10 and an upper surface of the pump lower body 30 to be fixed and the central portion of the suction valve plate 40 is tightly closed to the ring-shaped protrusion part 33 so that the air tightness is maintained.

Then, after an elastic member 60 is placed in the elastic member receiving groove 17 formed on the connecting piece 13 of the pump main body 10, the pump upper body 20 is fitted with the pump main body 10 by forcibly pressing the pump upper body 20, such that the vertical wall 21 of the pump upper body 20 is inserted into the inside of the bent protrusion wheel 14 of the pump main body 10 to be assembled.

In this case, the latching protrusion wheel 27 formed on the outer peripheral surface of the lower end of the vertical wall 21 of the pump upper body 20 is inserting while pressing the bent protrusion wheel 14 of the pump main body 10 to the outside. When the vertical wall 21 of the pump upper body 20 is inserted into the bent protrusion wheel 14 of the pump main body 10, the latching protrusion wheel 27 of the pump upper body 20 is latched to the bent protrusion wheel 14 of the pump main body 10, so that the pump upper body 20 is prevented from being separated from the pump main body 10.

When the pump upper body 20 is assembled with the pump main body as described above, the elastic member 60 is elastically supported between the pump upper body 20 and the pump main body 10 and is prevented from being exposed to an outside by the outer auxiliary wall 29 of the pump upper body 20 and the outer wall 12 of the pump main body 10.

Next, the discharge valve 50 is assembled with an upper part of the pump upper body 20. In this embodiment, the assembly of the discharge valve 50 with the pump upper body 20 by using the coupling auxiliary member 70 will be described below.

Since the coupling auxiliary member 70 has a ring shape, the coupling auxiliary member 70 is fitted onto the periphery of the coupling protrusion wheel 54 of the discharge valve 50. Since the discharge valve 50 is formed of rubber having excellent elasticity and the space is formed in the coupling protrusion wheel 54, while the coupling protrusion wheel 54 is pressed to be puckered, the coupling auxiliary member 70 is fitted on the periphery of the coupling protrusion wheel 54 of the discharge valve. In this case, the coupling protrusion wheel 71 of the coupling auxiliary member 70 is fitted into the coupling groove 55 of the discharge valve 50.

Next, the discharge valve 50 fitted with the coupling auxiliary member 70 is fitted onto the pump upper body 20 and the latching protrusion sill 72 of the coupling auxiliary member 70 is pressed to be assembled over the latching sill 25 formed on the protrusion piece 24-1 of the pump upper body 20.

In this case, the valve protrusion wheel 52 of the discharge valve 50 covers the extension protrusion wheel 26 to be tightly closed to the protrusion wheel 26, so that the valve protrusion wheel 52 seals the content outlet 22 formed on the extension protrusion wheel 26.

In addition, the outer periphery of the upper side of the discharge valve 50 is tightly closed to the upper surface of the upper extension piece 28 of the pump upper body 20. When the sealing protrusion wheel 56 is further formed on the outer periphery of the upper side of the discharge valve 50, the sealing protrusion wheel 56 is tightly closed to the upper surface of the upper extension piece 28 of the pump upper body 20.

Figure 17:
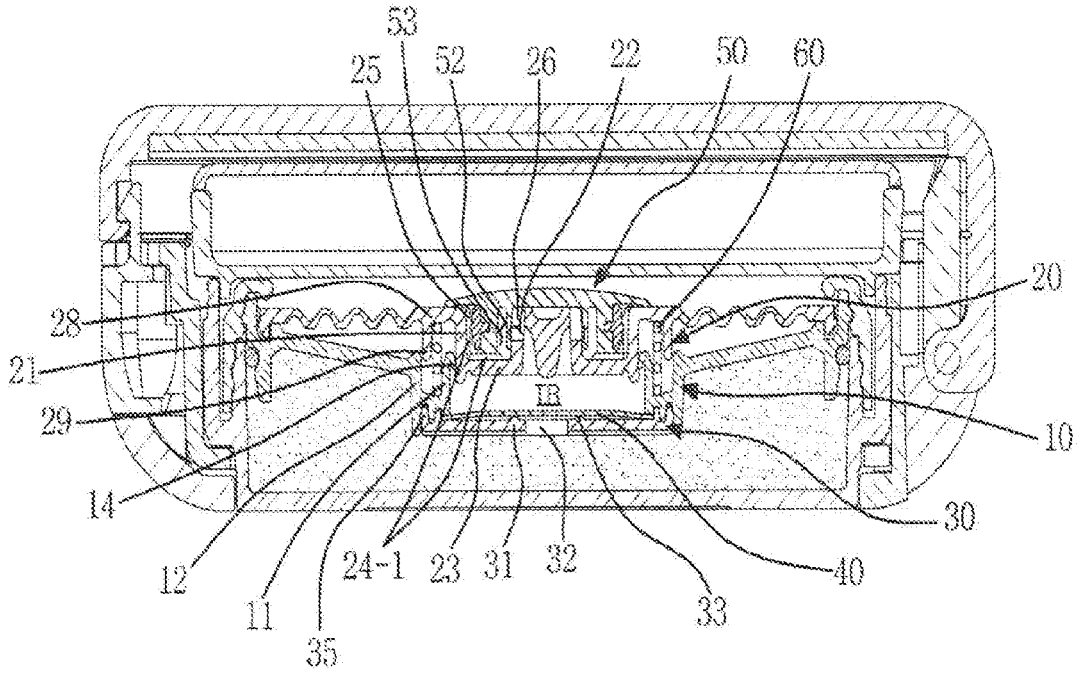
FIG. 17 is a sectional view entirely showing a state that a pump for discharging contents is applied to a compact according to an embodiment of the present invention.

The present invention assembled as described above may be fitted into the container V to be used as a content discharge valve. Alternatively, as shown in FIG. 17, the present invention may be fitted into a compact cosmetic container to be used as a content discharge valve.

The operation of the present invention configured as described above is as follows.

The container for discharging contents according to the present invention, which is coupled to a container V for use, may be used for a conventional cosmetic container, a daily supply container, a food container or a medicine container and may be uses as a package container having a height less than a width thereof such as a compact cosmetic container.

As shown in FIG. 9, according to the pump for discharging contents of the present invention, when the pump upper body 20 moves down by pressing the central portion of the upper surface of the pump upper body 20 or the discharge valve 50, the volume of a temporary repository TR in a pump main body 10 is reduced to generate pressure in the temporary repository TR, so that the suction valve plate 40 closes the content inlet 32. At the same time, the valve protrusion wheel 52, which is in tight contact with a content outlet 22 of an extension protrusion wheel 26, is widened due to the pressure, so that the contents in the temporary repository TR are discharged while passing thorough the widened gap between the content outlet 22 and the valve protrusion wheel 52.

Then, after passing through the flow path 24 which is the gap between the pump upper body 20 and the discharge valve 50, the discharge pressure is applied to the upper peripheral part of the discharge valve 50, so that the contents are discharged through the gap which is created between the upper surface of the pump upper body 20 and the upper peripheral part of the discharge valve 50.

In this case, when the sealing protrusion wheel 56 is formed on the upper periphery of the discharge valve 50, while the sealing protrusion wheel 56 is lifted up, the contents are discharged through the gap.

Thereafter, when the pressure on the discharge valve 50 or the pimp upper body 20 is removed, the pump upper body 20 moves up by the restoring force of the elastic member 60 and the space of the temporary repository (TR) in the pump main body 10 is enlarged, so that vacuum pressure is generated and the gap between the valve protruding ring 5) of the discharge valve 50 and the content outlet 22 is closed. As the boundaries of opening/closing lines 41 are widened while the central part of the suction valve plate 40 is lifted up due to the vacuum pressure, the contents in a container V are transferred to the temporary repository TR through the space between the suction valve plate 40 and the content inlet 32.

As shown in FIG. 15, the contents, which have passed through the content inlet 32, are transferred into the temporary repository TR through the gaps in the widened opening/closing lines 41 of the suction valve plate 40. When the contents are transferred so that the vacuum pressure in the temporary repository TR disappears, the widened opening/closing lines 41 are restored to the original state thereof and closed due to the elastic force of the suction valve plate 40, so that the suction valve plate 40 closes the content inlet 32.

The pump for discharging contents described in this disclosure is for an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Pump main body
11: Inner wall
13: Connecting piece
14: Bent protrusion piece
20: Pump upper body
21: Vertical wall
22: Content outlet
24: Flow path

26: Extension protrusion wheel
27: Latching protrusion wheel
28: Upper extension piece
30: Pump lower body
31: Blocking plate
32: Content inlet
33: Ring-shaped protrusion part
35: Coupling protrusion wall
40: Suction valve plate
41: Cutting line
50: Discharge valve
52: Valve protrusion wheel
54: Coupling protrusion wheel
56: Sealing protrusion wheel
60: Elastic member
70: Coupling auxiliary member
TR: Temporary repository
V: Container

The invention claimed is:

1. A pump for discharging contents, which is coupled to a container for containing the contents to discharge the contents, the pump comprising:

a suction valve plate (40) which closes a content inlet (32) as a volume of a temporary repository (TR) in a pump main body (10) is reduced and pressure is generated in the temporary repository (TR) when a pump upper body (20) moves down by pressing an upper surface of a pump upper body (20) or a discharge valve (50); and a valve protrusion wheel (52) in tight contact with a content outlet (22) of an extension protrusion wheel (26), wherein the valve protrusion wheel (52) is widened due to the pressure such that the contents in the temporary repository (TR) pass thorough a widened gap between the content outlet (22) and the valve protrusion wheel (52), and then, after passing through a flow path (24) which is a gap between the pump upper body (20) and the discharge valve (50), the contents are discharged through a gap which is created between an upper surface of the pump upper body (20) and an upper peripheral part of the discharge valve (50) as discharge pressure is applied to the upper peripheral part of the discharge valve (50), wherein, when the pressure on the upper surface of the discharge valve (50) or the pump upper body (20) is removed, the pump upper body (20) moves up by restoring force of an elastic member (60) and a space of the temporary repository (TR) in the pump main body (10) is increased, so that vacuum pressure is generated and the gap between the valve protruding ring (52) of the discharge valve (50) and the content outlet (22) is closed, wherein, as boundaries of opening/closing lines (41) are widened while a central part of the suction valve plate (40) is raised upward due to the vacuum pressure, the contents in the container (V) are transferred to the temporary repository (TR) through a space between the suction valve plate (40) and the content inlet (32), wherein the contents, which have passed through the content inlet (32), are transferred into the temporary repository (TR) through gaps in the widened opening/closing lines (41) of the suction valve plate (40), and wherein, when the contents are transferred so that the vacuum pressure in the temporary repository (TR) disappears, the widened opening/closing lines (41) are restored to an original state thereof and closed due to elastic force of the suction valve plate (40), so that the suction valve plate (40) closes the content inlet (32).

2. The pump of claim 1, wherein the pump for discharging the contents is used for a compact or a foundation cosmetic container having a height less than a width.

3. A pump for discharging contents, which is coupled to a container for containing the contents to discharge the contents, the pump comprising:

a pump main body (10);
a pump upper body (20);
a pump lower body (30);
a suction valve plate (40);
a discharge valve (50); and
an elastic member (60), wherein the pump main body (10) comprises an inner wall (11) formed at a center thereof with a hollow hole perforated in a vertical direction; a connecting piece (13) formed at an outside of the inner wall (11); and a bent protrusion wheel (14) integrally formed on an upper inside of the inner wall (11), wherein the pump upper body (20) comprises a vertical wail (21) formed to move vertically while being inserted into an inner wall (11) of the pump main body (10); an extension protrusion wheel (26) provided at a center of the pump upper body (20) and having a content outlet (22); a lower connecting plate (23) to integrally connect the vertical wall (21) with the extension protrusion wheel (26); and an upper extension, piece (28) extending from an upper outside of the vertical wall (21), wherein the pump lower body (30) is inserted into and coupled to a lower side of the pump main body (10) and comprises a flat-shaped blocking plate (31) and a content inlet (32) formed at a center of the flat-shaped blocking plate (31), wherein the suction valve plate (40) has a flat shape and is coupled between the pump main body (10) and the pump lower body (30) to form a plurality of opening/closing lines (41), wherein the discharge valve (50) is coupled to an upper side of the pump upper body (20) and comprises a valve protrusion wheel (52) for opening or closing the content outlet (22) of the pump upper body (20); a coupling protrusion wheel (54) coupled to the pump upper body (20) on an outside of the valve protrusion wheel (52); and a space (53) formed between the valve protrusion wheel (52) and the coupling protruding ring (54), and wherein the elastic member (60) is interposed between the pump main body (10) and the pump upper body (20) to elastically support the pump upper body (20).

4. The pump of claim 3, further comprising an outer wall (12) formed at an outside of the connecting piece (13) of the pump main body (10).

5. The pump of claim 3, wherein the bent protrusion wheel (14) protrudes while being bent inwardly, and, when the vertical wall (21) of the pump upper body (20), which is greater than an inner diameter of the bent protrusion piece (14), is fitted, the bent protrusion piece (14) is subject to elasticity while being bent such that air tightness is formed with respect to the vertical wall (21) of the pump upper body (20).

6. The pump of claim 3, wherein the pump main body (10) and the pump upper body (20) are formed of synthetic resin including polyethylene (PE).

7. The pump of claim 3, further comprising a latching protrusion wheel (27) protruding from an outer peripheral surface of a lower end of the vertical wall (21) of the pump upper body (20).

8. The pump of claim 3, further comprising an outer auxiliary wall (29) formed below an outer end of the upper extension piece (28).

9. The pump of claim 3, further comprising a content induction bar (26-1) formed on an inside of the extension protrusion wheel (26) and having a streamlined surface.

10. The pump of claim 3, wherein the opening/closing line (41) includes one of a wave-shaped cutting line, an arc-shaped cutting line, a diagonal-sharped cutting line and a straight cutting line.

11. The pump of claim 3, further comprising a sealing protrusion wheel (56) protruding from an outer periphery of the discharge valve (50).

12. The pump of claim 3, wherein the pump for discharging the contents is used for a compact or a foundation cosmetic container having a height less than a width.

13. A pump for discharging contents, which is coupled to a container for containing the contents to discharge the contents, wherein a suction valve plate (40) is assembled with a pump lower body (30) below a pump main body (10) and, after an edge of the suction valve plate (40) is tightly closed to a lower end of an inner wall (11) of the pump main body (10), a coupling protrusion wall (35) of the pump lower body (30) is inserted between an outer wall (12) of the pump main body (10) and a sealing protrusion wheel (15), such that a coupling protrusion wheel (36) of the pump lower body (30) is coupled to a coupling groove (16) of the pump main body (10), wherein, after an elastic -member (60) is placed on a connecting piece (13) of the pump main body (10), a pump upper body (20) is fitted with the pump main body (10) such that the elastic member (60) is elastically supported between the pump upper body (20) and the pump main body (10), wherein a vertical wall (21) of the pump upper body (20) is pressed to be inserted into an inside of a bent protrusion wheel (14) of the pump main body (10), wherein a coupling protrusion wheel (54) of a discharge valve (50) is fitted with a coupling auxiliary member (70), wherein the discharge valve (50) fitted with the coupling auxiliary member (70) is fitted onto the pump upper body (20) and a valve protrusion wheel (52) of the discharge valve (50) covers an extension protrusion wheel (26) to close a content outlet (22), and wherein a latching protrusion sill (72) of the coupling auxiliary member (70) is pressed and assembled to be coupled over a latching sill (25) formed on a protrusion piece (24-1) of the pump upper body (20).

14. The pump of claim 13, wherein the pump for discharging the contents is used for a compact or a foundation cosmetic container having a height less than a width.

* * * * *